US005186253A

United States Patent [19]

Gustafson et al.

[11] Patent Number: 5,186,253

[45] Date of Patent: Feb. 16, 1993

[54] PORTABLE GROUNDWATER SAMPLING DEVICE

[75] Inventors: Gregg S. Gustafson, Bothell; Jay M. Kuga, Bellevue, both of Wash.

[73] Assignee: Instrumentation Northwest, Inc., Redmond, Wash.

[21] Appl. No.: 705,761

[22] Filed: May 28, 1991

[51] Int. Cl.[5] ..... E21B 19/00

[52] U.S. Cl. ..... 166/77; 166/77.5

[58] Field of Search ..... 166/162, 77, 385, 264, 166/65.1

[56] References Cited

U.S. PATENT DOCUMENTS

| | | | |
|---|---|---|---|
| 4,249,600 | 2/1981 | Bailey | 166/77 |
| 4,570,705 | 2/1986 | Walling | 166/77 |
| 4,673,035 | 6/1987 | Gipson | 166/77 |

OTHER PUBLICATIONS

Greenlee Corporation catalog pages (encircled Nos. 1 through 4).

Bennett sample pump advertisement (encircled No. 5).

Keck Instruments, Inc., catalog page (encircled No. 6).

Clifford B. Hannay & Son, Inc., catalog page (encircled No. 7).

*Primary Examiner*—Thuy M. Bui

*Attorney, Agent, or Firm*—H. Albert Richardson

[57] ABSTRACT

A device for monitoring the physical characteristics of groundwater or other fluids. The sampling device includes a frame, a hanger for suspending the device from the wellhead, a service cable storage reel mounted for rotation on the frame, a handle for rotating the reel, a lock for preventing rotation of the reel with respect to the frame and a guide for directing the service cable from the reel into the wellhead. The device also may include a service cable which includes discharge hose and an electrical cable which are bonded together to function as a unitary cable and a cable block for sealing the lower end of the electrical cable to prevent the incursion of groundwater.

10 Claims, 5 Drawing Sheets

PORTABLE GROUNDWATER SAMPLING DEVICE

BACKGROUND OF THE INVENTION

This invention relates generally to fluid pumping apparatus and more particularly to a portable groundwater sampling unit for use in water quality control.

In recent years, federal, state and local environmental regulations have been imposed to require the monitoring of groundwater quality. Among the requirements of these regulations is that monitoring wells be installed in the vicinity of regulated groundwater supply facilities. Because the design and construction of sampling wells differs significantly from that of supply wells, new technology has been required to provide accurate, efficient, and consistent testing of water samples.

The early equipment developed for groundwater sampling had many inadequacies. Much of the equipment was quite expensive, complicated to operate, and impractical for use in remote locations. Also, sampling results were negatively effected by improper handling and field cleaning of the equipment, as well as inconsistent well depth sampling. Further, most of the equipment was so heavy and bulky that it was impractical to attempt to transport it from site to site. As a result, installations were made usually at each testing site which further increased the cost of testing.

As the number of regulated sites and testing programs expanded, it became apparent that the development of practical and effective portable sampling equipment was a necessity. At present the number of portable sampling units are available on the market. These units typically include a pneumatically or electrically operated sampling pump and a service hose which provides pneumatic or electric power to the pump and a conduit for carrying water samples to the surface. They also include a storage reel and a frame or stand on which the reel is mounted. As a group, however, these units continue to exhibit many of the deficiencies found in early sampling equipment. Many are too large or heavy to be easily transported or operated by one person. For example, some units require, when recovering the pump from the sampling well, that the operator hold the unit above the wellhead with one hand and attempt to operate the reel with the other in order to avoid scuffing the service cable on the upper edge of the wellhead. Also, many of them employ a service cable which is inherently difficult to clean in the field or which permits incursion of well water into the cable, thereby increasing the likelihood of cross contamination between wells.

Accordingly, it is an object of this invention to provide for an improved portable groundwater sampling unit which is easily transportable and operable by a single operator.

Particularly, it is an object of this invention to provide for a sampling unit which can be suspended from a conventional wellhead in such a manner and position that the service hose is guided directly from the storage reel to the well casing, thus reducing the possibility of damage to it during operation and eliminating the necessity of the operators holding the reel assembly during pump retrieval operations.

Another object of this invention to provide for improved service hose for a portable groundwater sampling unit which functions as a unitary cable when being wound on a reel and which is sealed to prevent leakage of well water into the hose.

SUMMARY OF THE INVENTION

This invention can be broadly summarized as providing for an improved portable groundwater sampling unit for use in monitoring the quality of groundwater. The preferred embodiment includes a frame having means for suspending the unit from the wellhead, a storage reel mounted for rotation on the frame, means for rotating the reel, means for locking the reel with respect to the frame, and means guiding a service hose from the reel into the wellhead.

In accordance with a more detailed aspect of the invention, the means for suspending the unit include a hanger bar attached to the frame and a hanger pin extending through the hanger bar and adapted to engage the wellhead.

This invention can also be described as providing for a novel service hose for use with a groundwater sampling pump. The new hose includes a passageway for the transport of liquid, particularly groundwater. It also includes an insulated electrical conductor means for providing power to the pump, and an integral cable means for supporting the pump.

DESCRIPTION OF THE PREFERRED EMBODIMENT

Figure 1:
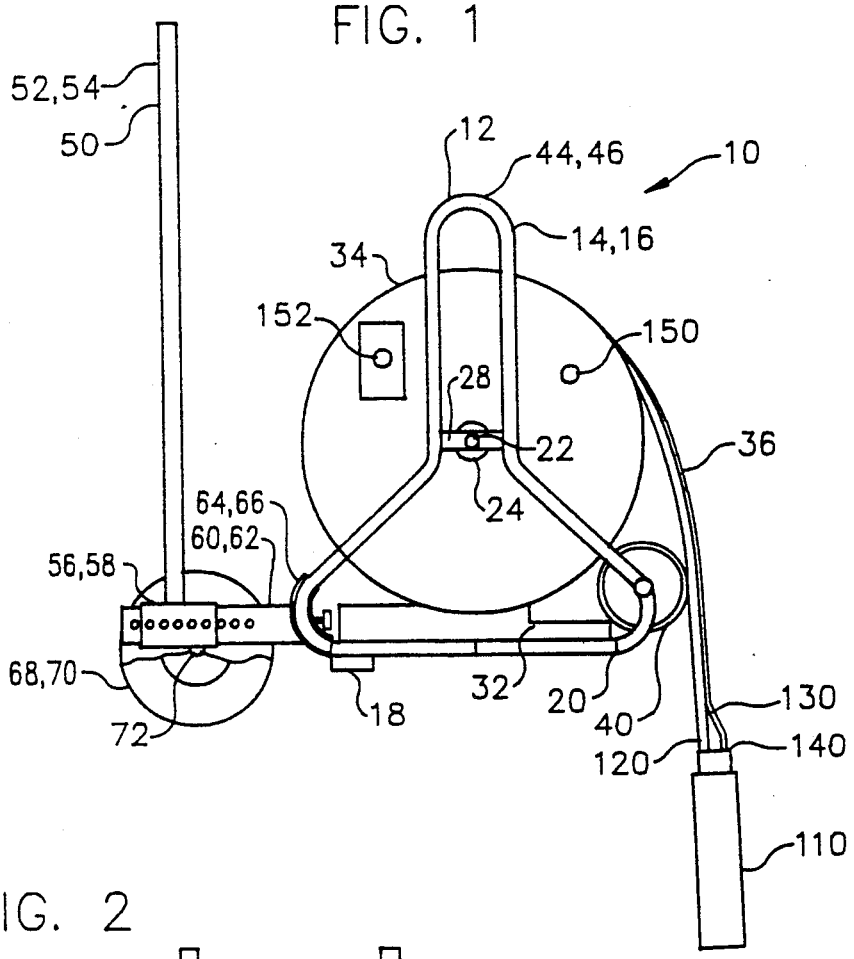
FIG. 1 is a front view of a portable groundwater sampling unit in accordance with the present invention.
Figure 2:
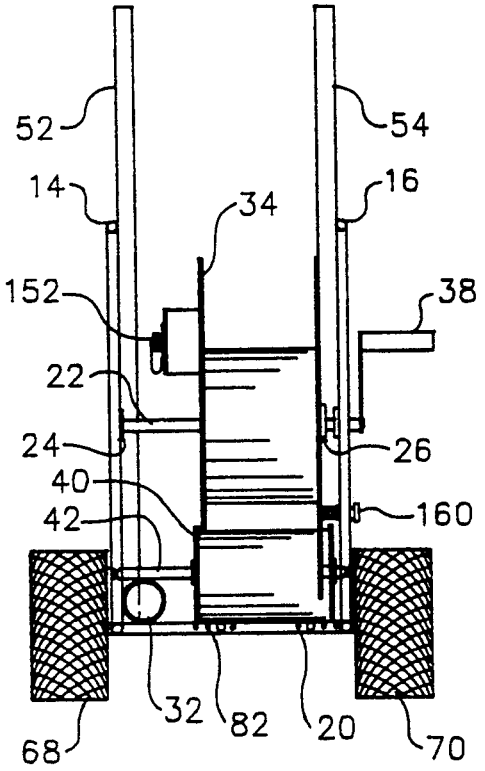
FIG. 2 is a right-side view of the unit.

The novel features believed to be characteristic of this invention are set forth in the appended claims. The invention itself, however, may be best understood, and its various objects and advantage best appreciated, by reference to the detailed description below in connection with the accompanying drawings.

FIGS. 1 through 5 illustrate a portable groundwater sampling unit constructed in accordance with the teachings of the present invention and generally designated by the number 10. The unit includes a frame 12 having a pair of spaced side members 14 and 16. The side members are joined by angle plate 18 and hanger bar 20, each of which extends horizontally between them. Reel shaft 22 is mounted for rotation in bearings 24 and 26 which are mounted to the side members by brackets 28 and 30, respectively. Tubular pump holster 32, which provides a storage place for the sampling pump (discussed below) is fastened to angle plate 18 and hanger bar 20.

Reel 34 which provides storage for the pump service cable 36 is mounted on shaft 22. The reel may be rotated by the operator by means of handle 38 which is detachable for convenience. Alternately, power means such as an electric motor could be provided to rotate the reel. The details of such power means and its attachment to the reel should be obvious to those of ordinary skill. Cable guide roller 40 is mounted for rotation on shaft 42 which extend horizontally between the forward end of the side members. Alternately, a channel member in which the cable could slide could be used as a guide. Upper ends 44 and 46 of the side members which extend above the reel, function as handles by which the units can be lifted.

In order to facilitate transport of the sampling unit the preferred embodiment also includes detachable hand truck 50. It includes vertically extending handles 52 and 54 which are welded to channel members 56 and 58, respectively. Channel members 56 and 58 are slidably mounted on horizontally oriented bars 60 and 62, respectively. The hand truck is attached to frame side members 14 and 16 by clamp assemblies 64 and 66, respectively. The position of handles 52 and 54 may be fixed on the bars by passing bolts through mating holes in channel members 56 and 58 and through the bars as shown. Wheels 68 and 70 are mounted for rotation on axle 72, which is welded to the bottom of channels 56 and 58 as shown. By adjusting the positions of channels 56 and 58 on bars 60 and 62, the extent to which the reel is elevated when the sampling unit is pivoted about the wheels can be varied.

Figure 3:
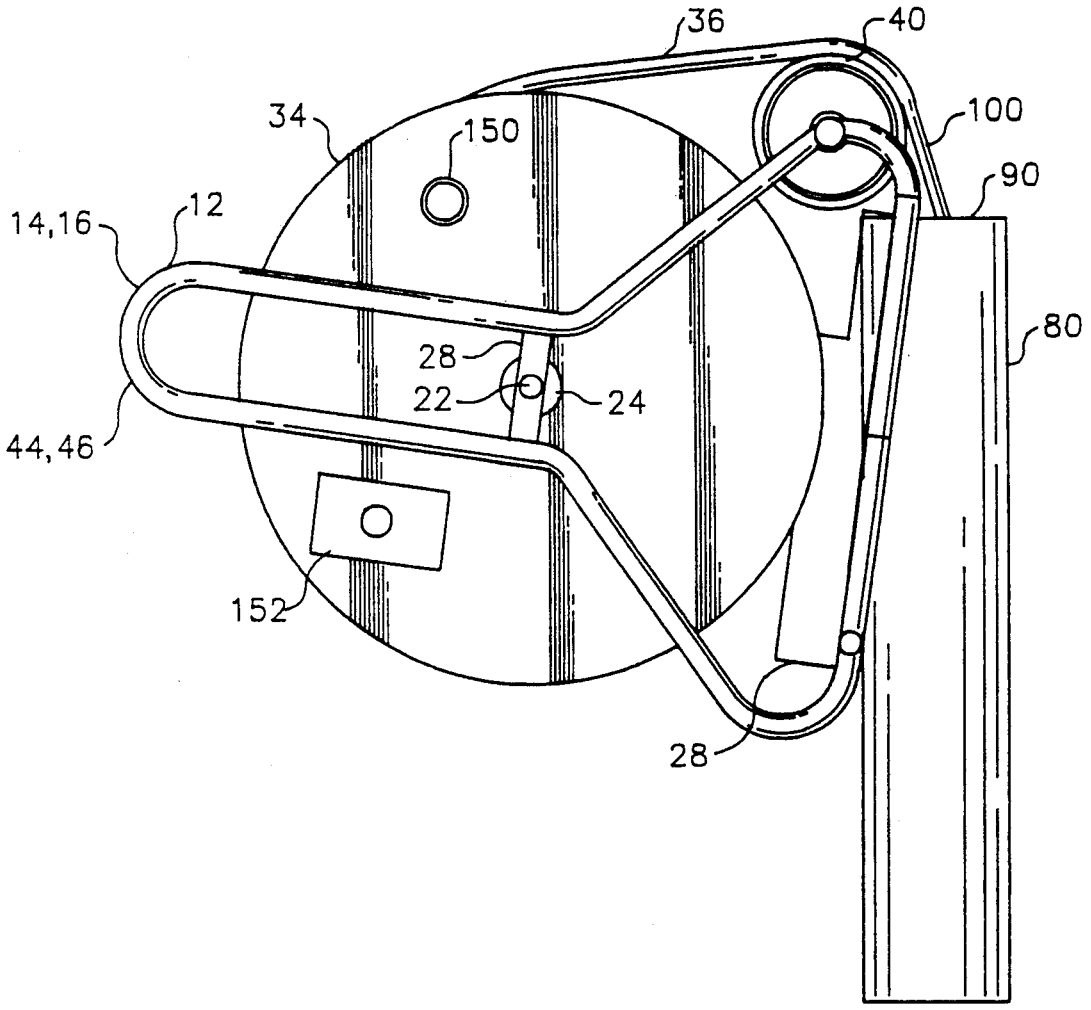
FIG. 3 illustrates the unit from which the optional hand truck has been removed/suspended from a wellhead.
Figure 4:
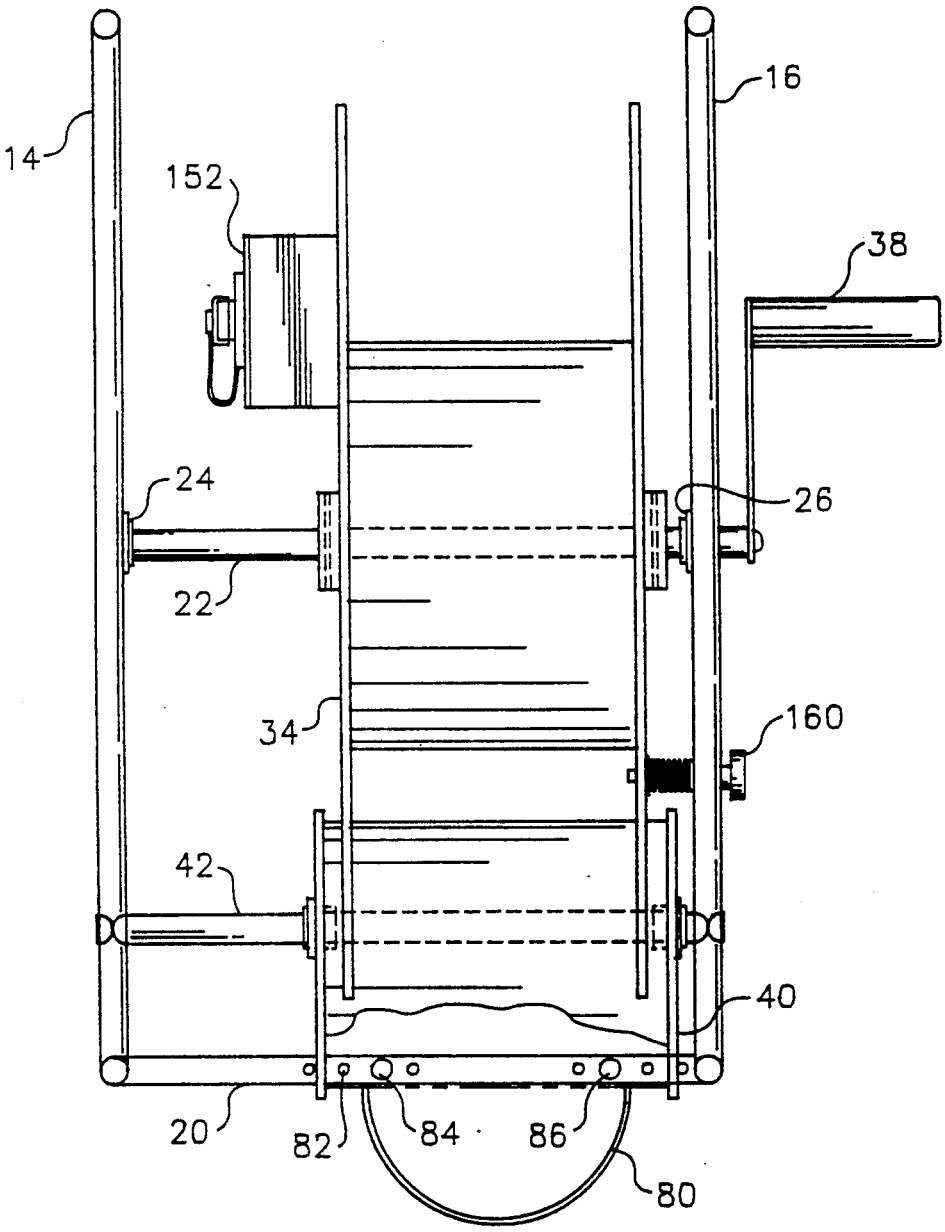
FIG. 4 is a top view of the unit of FIG. 3.
Figure 5:
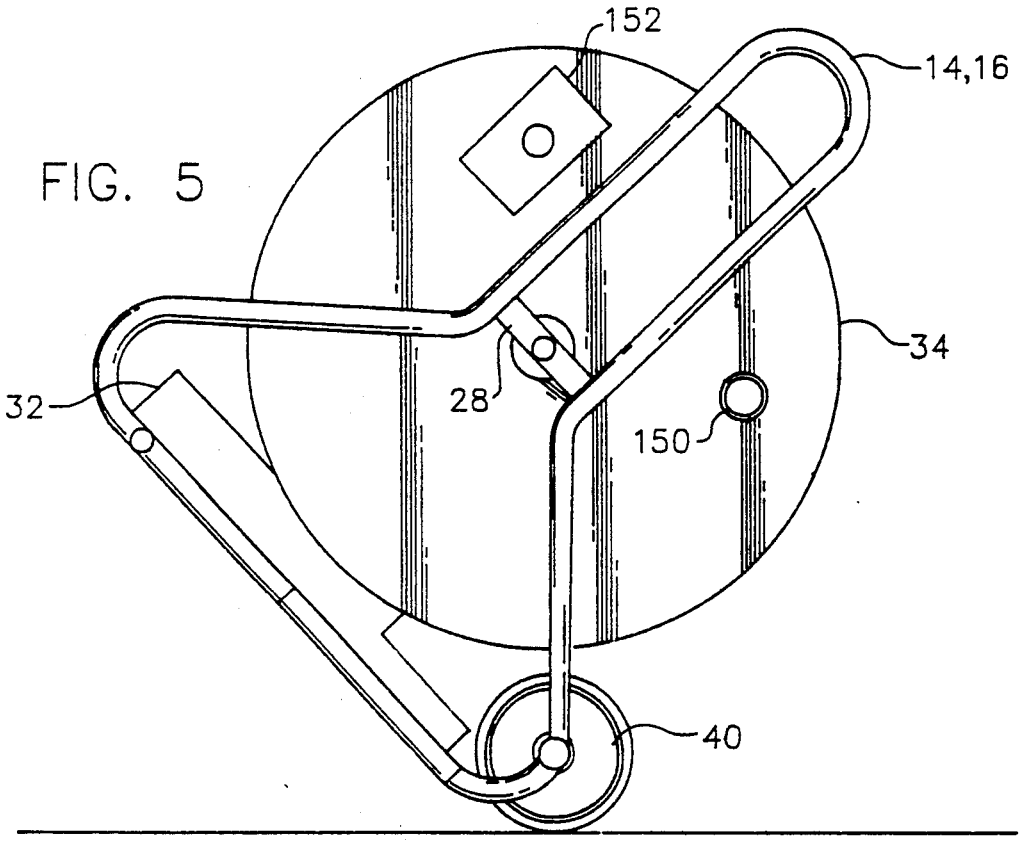
FIG. 5 illustrates the unit tilted to rest upon the service cable roller for transport.
Figure 6:
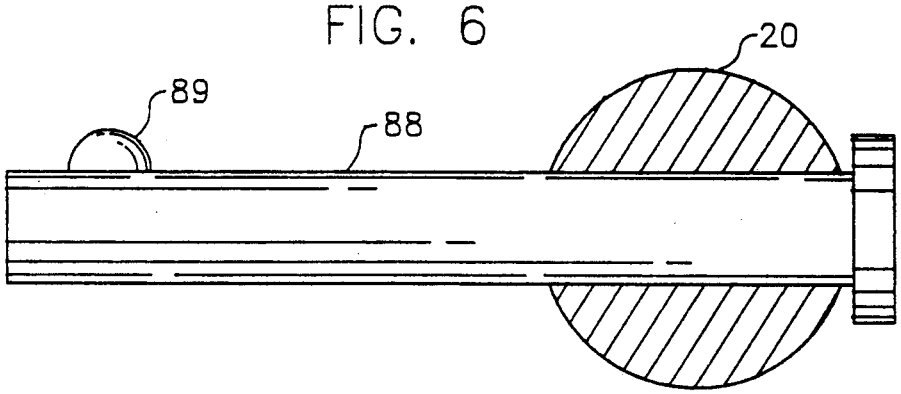
FIG. 6 is a sectional view taken at 6—6 in FIG. 4.

A significant advantage of the present invention over portable sampling units found in the prior art is that it can be suspended from a wellhead during operation. FIGS. 3 and 4 illustrate the present sampling unit positioned on a typical wellhead in that manner. The wellhead, designated by the number 80, normally extends about three feet above the surface of the ground at the site of the sampling well. The means to suspend the unit include hanger bar 20 in which a plurality of spaced holes such as hole 82 have been formed. These details are best seen in FIG. 4 where a portion of guide roller 40 has been cut away to show the holes in the bar. The suspension means also include a pair of hanging pins 84 and 86 which are removably insertable in the holes. By appropriate positioning of the pins in the holes, the position of the sampling unit, and particularly roller 40, can be adjusted with respect to upper end 90 of the wellhead. Pins 84, which is typical, is shown in detail in FIG. 6. It includes shaft 88 in which spring loaded retention ball 89 is mounted. By appropriately positioning the roller over the wellhead, service cable 36 (which will be described in greater detail below) can be accurately guided into the wellhead. This feature of the invention thus eliminates scuffing and excessive bending to the cable during lowering and withdrawal of the sampling pump.

Obviously, other suspension means could be substituted for the bar and pin arrangement described. For example, one or more hooks could be fastened to the frame or to bar 20 to suspend the unit from the wellhead. Alternately, other protruding members could be extended from bar 20 so as to function like the pins.

Another novel aspect of this invention is service cable 36. A service cable for a sampling pump must perform a number of functions. First, it must provide power for operating the pump. Secondly, it must provide a conduit for groundwater removed from the well by the pump during flushing operations or for sampling purposes. Preferably, the present embodiment includes an electrically powered sampling pump 110 which requires an insulated multi-conductor electrical cable for operation. The details of such a pump are well known to those of ordinary skill in the art and will not be described in further detail here.

One of the problems encountered with a multi-purpose service cable such as required for use with the present invention is that the discharge hose and the electrical cable are normally quite different in diameter and therefore will not remain in a fixed longitudinal lengthwise position with respect to one another when they are rolled onto the drum. In attempting to solve this problem the manufactures of previously known service cables have enclosed the hose and cables making up the service cable within a single housing or bound them tightly together at spaced locations with tape or the like. Neither method has proven very satisfactory and has tended to make the cables quite difficult to clean. Further, where a single housing is used to enclose the tube and cable, water from the well tends to penetrate the lower end of the housing and cause cross-contamination when the cable is used in other sampling wells.

Figure 8:
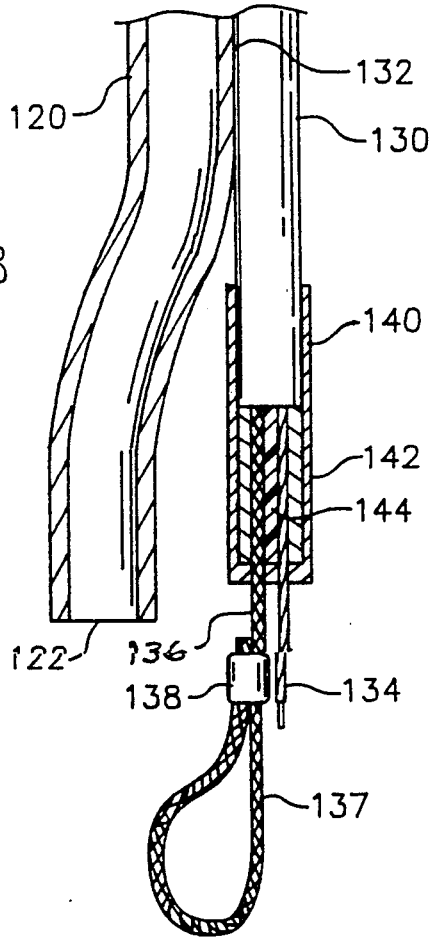
FIG. 8 is a sectional view of a portion of the service cable.

FIG. 8 illustrates the end of service cable 36 of the present invention which is adapted to be attached to pump 110. The cable includes discharge hose 120 which has adapted to be connected to the output port of the pump at end 122 and is used to transport groundwater from the well to the surface. It also includes multi-conductor insulated electrical cable 130 which is thermally bonded to hose 120 at interface 132 along the entire length of the service cable except in the vicinity of the cable ends. The bonding of the cable and the hose can be accomplished by means well known to those of ordinary skill in the art. The purpose for bonding the hose and cable together is to create a service cable which functions like a unitary or single cable when it is accumulated on the storage reel. An alternate way to construct such a cable would be to extrude a single cable housing having longitudinal passage ways formed in it through which fluid can be conducted and insulated electrical conductors could be run.

Cable 130 includes one of more insulated electrical wires 134 and strain relief cable 136. The purpose of the strain relief cable is to provide support for the pump and the weight of the service cable and relieve load on the discharge hose and electrical cord. The cable, which is preferably formed from stainless steel wire, is attached to the pump by means of loop 137 which is fastened by crimp 138. In order to eliminate the possibility of water entering the lower end of electrical cable 130 during operation it is completely sealed by means of cable block 140. The cable block includes block housing 142 which is filled with a thermoplastic or silicon waterproof adhesive 144.

During operation the upper end of the discharge hose is connected to bulkhead connector 150 and the upper end of the electrical cable is connected to external power at input box 152 on the reel.

Figure 7:
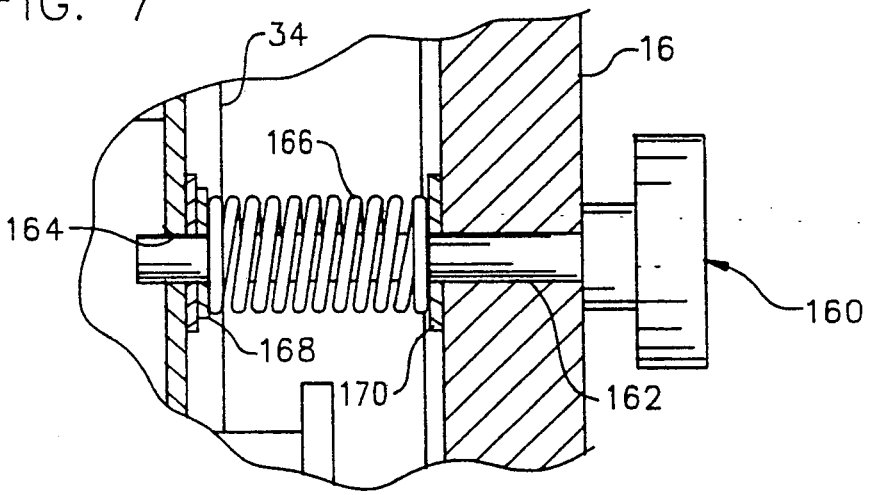
FIG. 7 is a sectional view of a portion of the frame and reel showing the reel lock.

Finally, it is desirable to lock the reel with respect to the frame when the pump has been lowered to the desired position in the well or when the service unit is not in use. Reel lock 160, illustrated in FIG. 7, is provided for that purpose. The lock includes locking pin 162 which is slidably mounted through frame member 16. It has an extended position as shown in which it engages reel 34 through hole 164, and a retracted position where it is clear of hole 164, permitting the reel to rotate freely. Spring 166, which extends between washer 168 (attached to the pin) and washer 170, biases the pin toward the extended position. Obviously other locking arrangements could be substituted.

Thus it can be seen that the present invention provides for an improved portable groundwater sampling unit which incorporates many novel features and offers significant advantages over the prior art. Although only one embodiment of this invention has been illustrated and described it is to be understood that obvious modifications can be made of it without departing from the true scope and spirit of the invention.

We claim:

1. A device for monitoring the physical characteristics of ground water or other fluids and adapted for use with a well having a wellhead, the system comprising;

a frame including means for suspending the device from the wellhead;

a storage reel mounted for rotation on the frame;

means for rotating the reel;

means for locking the reel with respect to the frame; and means for guiding a service cable from the reel to the wellhead.

2. The device of claim 1 wherein the means for suspending includes a protrusion adapted to extend into the top of the wellhead.

3. The device of claim 2 wherein the means for suspending includes a hanging bar and wherein the protrusion extends from the bar.

4. The device of claim 3 wherein the bar includes a plurality of spaced openings and the means for suspending includes at least two pins adapted to be removably mounted in the holes.

5. The device of claim 1 wherein the means for suspending includes a hook adapted to engage the top of the wellhead.

6. The device of claim 1 wherein the means for rotating the reel includes a handle attached to the reel.

7. The device of claim 6 wherein the means for rotating includes an electric motor operable connected to the reel.

8. The device of claim 1 wherein the means for guiding includes a roller mounted for rotation on the frame.

9. The device of claim 1 wherein the means for guiding includes a channel member adapted to be slidably engaged by the service cable.

10. A device for monitoring the physical characteristics of ground water or other fluids and adapted for use with a well having a wellhead, the system comprising:

a frame including means for suspending the device from the wellhead, the suspending means including a hanging bar and at least two pins removably mounted to the bar and adapted to engage the top of the wellhead;

a storage reel mounted for rotation on the frame;

a handle for rotating the reel;

means for locking the reel with respect to the frame;

a service cable including a discharge tube providing a passageway for the transport of fluid, an electrical cable including insulated electrical conductor means, and integral support cable means for supporting the service cable and the pump wherein the discharge tube and the electrical cable are longitudinally bonded; and a roller mounted for rotation to the frame for guiding the service cable from the reel to the wellhead.

* * * * *